US011002263B2

(12) United States Patent
Gao et al.

(10) Patent No.: US 11,002,263 B2
(45) Date of Patent: May 11, 2021

(54) TWO-STAGE HIGH-PRESSURE PUMP WITH HIGH SEALING PERFORMANCE

(71) Applicant: NANTONG GUANGXING PNEUMATIC EQUIPMENT CO., LTD., Nantong (CN)

(72) Inventors: Xuefeng Gao, Nantong (CN); Jinhai Chen, Nantong (CN); Mingming Su, Nantong (CN); Yanfei Dai, Nantong (CN); Yangqing Gao, Nantong (CN)

(73) Assignee: NANTONG GUANGXING PNEUMATIC EQUIPMENT CO., LTD., Nantong (CN)

( * ) Notice: Subject to any disclaimer, the term of this patent is extended or adjusted under 35 U.S.C. 154(b) by 0 days.

(21) Appl. No.: 16/464,686

(22) PCT Filed: Jun. 27, 2018

(86) PCT No.: PCT/CN2018/093020
§ 371 (c)(1),
(2) Date: May 29, 2019

(87) PCT Pub. No.: WO2019/047592
PCT Pub. Date: Mar. 14, 2019

(65) Prior Publication Data

US 2019/0390668 A1 Dec. 26, 2019

(30) Foreign Application Priority Data

Sep. 11, 2017 (CN) ..... 201710812243.9

(51) Int. Cl.
*F04B 25/00* (2006.01)
*F04B 39/00* (2006.01)
(Continued)

(52) U.S. Cl.
CPC ..... *F04B 25/00* (2013.01); *F04B 39/0094* (2013.01); *F04B 39/06* (2013.01);
(Continued)

(58) Field of Classification Search
CPC ..... F04B 49/08; F04B 49/22; F04B 53/143; F04B 25/00; F04B 25/005; F04B 39/00;
(Continued)

(56) References Cited

U.S. PATENT DOCUMENTS 3,747,404 A * 7/1973 Novak ..... F04C 28/24 73/168
6,577,089 B1 * 6/2003 Piedl ..... F04B 49/065 318/432

(Continued)

FOREIGN PATENT DOCUMENTS

CN 103790798 A * 5/2014 ..... F04B 39/0292
CN 203835653 U 9/2014

(Continued)

*Primary Examiner* — Essama Omgba
*Assistant Examiner* — Christopher J Brunjes
(74) *Attorney, Agent, or Firm* — Bayramoglu Law Offices LLC

(57) ABSTRACT

A two-stage high-pressure pump includes a reduction gearbox disposed in front of a motor, a-crank shaft connected to an output shaft of the reduction gearbox, a connecting rod having one side connected to the crank shaft and the other side connected to a primary piston, a primary one-way valve disposed at one end of the primary piston, and a gas storage chamber provided at the middle of the primary piston. The other end of the primary piston is connected to a secondary piston rod in a highly sealed manner. The secondary piston rod is provided with a vent in the middle, and the other end of the secondary piston is connected to a high-pressure piston. A secondary one-way valve is disposed in the secondary high-pressure piston. A noise attenuating filter and a
(Continued)

one-way valve block are disposed at an air inlet of the primary cylinder cover.

9 Claims, 1 Drawing Sheet

(51) Int. Cl.
*F04B 39/06* (2006.01)
*F04B 49/22* (2006.01)
*F04B 53/14* (2006.01)
*F04B 49/08* (2006.01)

(52) U.S. Cl.
CPC ..... *F04B 49/08* (2013.01); *F04B 49/22* (2013.01); *F04B 53/143* (2013.01)

(58) Field of Classification Search
CPC ..... F04B 39/0094; F04B 39/06; F04B 39/10; F04B 39/16; F04B 39/0016; F04B 35/01; F04B 3/00; F04B 3/003; F04B 7/045; F04B 9/02; F04B 9/025; F04B 9/045; F04C 14/24
USPC ..... 417/454, 415, 439, 300, 308, 307; 123/446, 448, 445, 506
See application file for complete search history.

(56) References Cited

U.S. PATENT DOCUMENTS

2003/0178377 A1* 9/2003 Larson ..... B01D 17/0214 210/799
2004/0072046 A1* 4/2004 Schmidt ..... H01M 8/04089 429/410
2007/0084463 A1* 4/2007 Niemann ..... A62B 9/003 128/201.25
2010/0166573 A1* 7/2010 Magami ..... F04B 9/113 417/267
2012/0282114 A1* 11/2012 Cannata ..... F04B 35/008 417/53
2014/0377080 A1 12/2014 Xiao et al.
2016/0265524 A1* 9/2016 Gao ..... F04B 25/00
2016/0281705 A1 9/2016 Adler et al.

FOREIGN PATENT DOCUMENTS

CN 205605379 U 9/2016
CN 206309544 U 7/2017
CN 107642474 A 1/2018
CN 207406449 U 5/2018
EP 2916001 A1 9/2015
WO 2016175375 A1 11/2016

* cited by examiner

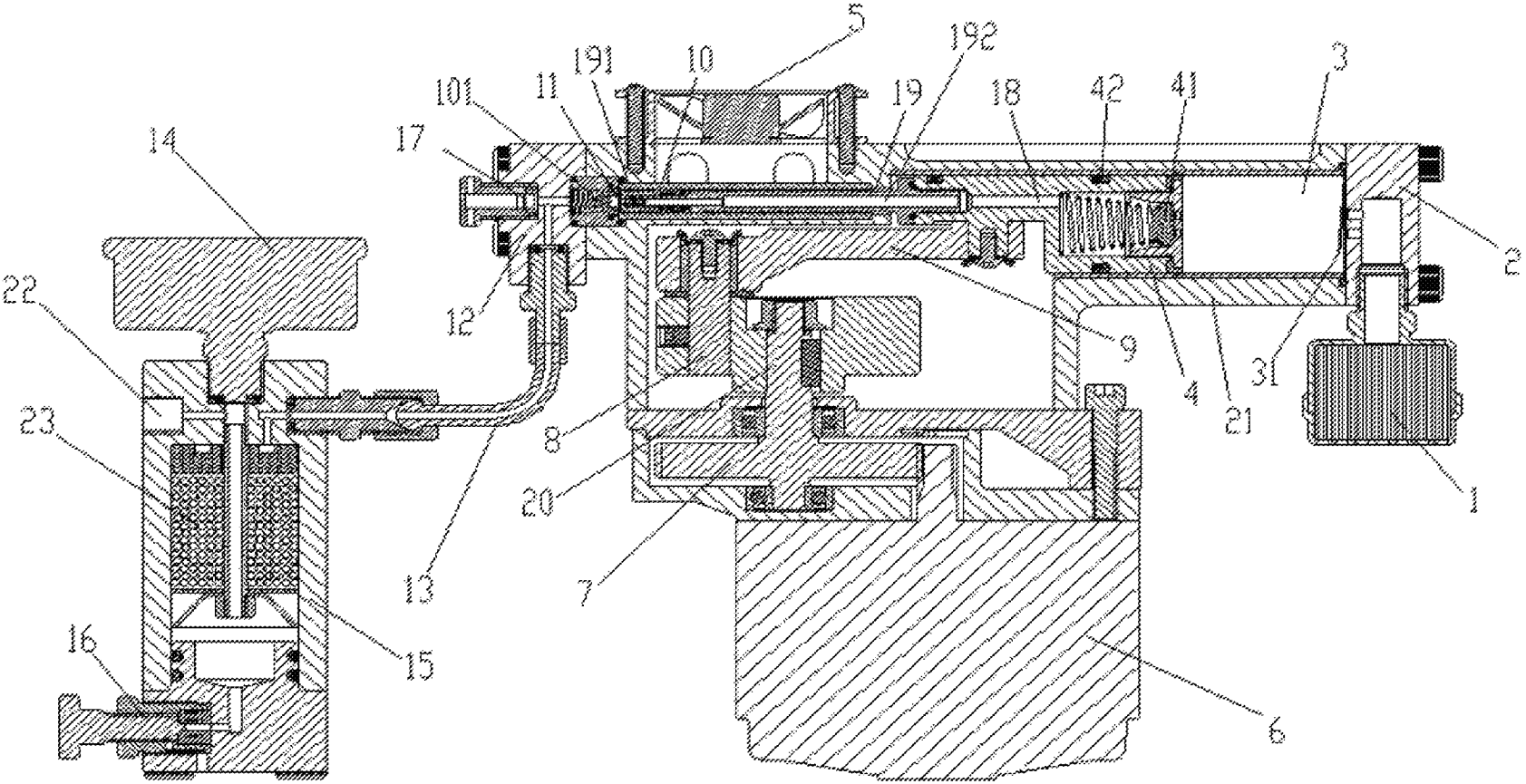
1
2
3
31
21
4
41
42
18
192
19
9
5
10
191
11
101
17
12
13
14
15
16
22
23
8
20
7
6

TWO-STAGE HIGH-PRESSURE PUMP WITH HIGH SEALING PERFORMANCE

CROSS REFERENCE TO THE RELATED APPLICATIONS

This application is the national phase entry of International Application No. PCT/CN2018/093020, filed on Jun. 27, 2018, which is based upon and claims priority to Chinese Patent Application No. 201710812243.9, filed on Sep. 11, 2017, the entire contents of which are incorporated herein by reference.

TECHNICAL FIELD

The present invention relates to an air pump, and specifically to a two-stage high-pressure pump with high sealing performance.

BACKGROUND

An existing plunger air pump basically consists of a pump body and a motor mounted outside the pump body to drive the pump body. As increasingly more small household appliances use air pumps, the air pumps are applied in an increasingly wider range, and the output air pressure needs to meet higher requirements. However, ordinary air pumps currently on the market obviously cannot meet the requirements, and it is often the case that the pressure is insufficient and the sealing performance is poor.

SUMMARY

An objective of the present invention is to provide a two-stage high-pressure pump with high sealing performance, which outputs gas with a high pressure and achieves desirable sealing performance, so as to solve the defects and disadvantages of the prior art.

In order to achieve the objectives above, the present invention employs the following technical solution: a two-stage high-pressure pump with high sealing performance, including: a motor, a noise attenuating first filter and a second filter. A reduction gearbox is disposed in front of the motor. An output shaft is disposed in the reduction gearbox. One end of the output shaft is connected to a crank shaft. One end of the crank shaft is connected to a connecting rod. The connecting rod has one end connected to the crank shaft and the other end connected to a primary piston. A primary cylinder is disposed at one end of the primary piston, and the other end of the primary piston is connected to a secondary piston rod. A primary cylinder cover is disposed at one end of the primary cylinder. A cylinder block is fixed on the periphery of the primary cylinder. The primary cylinder cover is connected to the noise attenuating first filter. The secondary piston rod and the primary piston are connected in a sealed manner. The other end of the secondary piston rod is connected to a secondary piston. A secondary cylinder is disposed at one end of the secondary piston. One end of the secondary cylinder is connected to a cylinder cover. One end of the cylinder cover is connected to a pressure relief valve, and the other side of the cylinder cover is connected to the second filter through a gas pipe.

A pressure gauge is disposed above the second filter. A release valve is disposed at a lower end of the second filter. An oil-water separation component is disposed inside the second filter. One side of the second filter is provided with a high-pressure outlet.

A one-way valve block is disposed between the primary cylinder cover and the primary cylinder.

A gas storage chamber is provided inside the primary piston. A primary one-way valve is disposed at one end of the primary piston. A guide ring is sleeved over the primary piston.

A vent is provided inside the secondary piston rod. The vent has one end connected to the gas storage chamber and the other end connected to the secondary piston.

A secondary one-way valve is disposed inside the secondary piston, and a one-way valve is disposed on one side of the cylinder cover.

The cylinder block is connected to the reduction gearbox.

A heat sink is further disposed outside the secondary cylinder.

The primary piston has a diameter and an area larger than those of the secondary piston rod.

Compression cavities are provided for the primary and the secondary cylinders, the primary cylinder and the secondary cylinder are arranged such that the central axes of the primary cylinder is radially offset from the central axes of the secondary cylinder, and the central axes of the primary cylinder cavity is radially offset from the central axes of the secondary cylinder cavity.

After using the foregoing technical solution, the present invention achieves the following beneficial effects: the primary cylinder and the secondary cylinder of the air pump are designed to be arranged such that the central axes of the primary cylinder is radially offset from the central axes of the secondary cylinder, the central axes of the primary cylinder cavity is radially offset from the central axes of the secondary cylinder cavity, and the central axes of the primary piston is radially offset from the central axes of the secondary piston, so that the pump applies balanced forces during operation, has a small size, achieves energy conservation and environmental protection, outputs gas under high pressure, and has good sealing performance.

BRIEF DESCRIPTION OF THE DRAWINGS

In order to illustrate the technical solutions in the embodiments of the present invention or in the prior art more clearly, accompanying drawings needed for the description of the embodiments or the prior art will be introduced briefly below. Obviously, the drawings in the following description show merely some embodiments of the present invention. Those of ordinary skill in the art can further obtain other drawings according to these drawings without making creative efforts.

FIG. 1 is a schematic structural diagram of the present invention.

DETAILED DESCRIPTION OF THE EMBODIMENTS

Referring to FIG. 1, this embodiment employs the following technical solution: A two-stage high-pressure pump with high sealing performance includes a motor 6, a noise attenuating first filter 1 and a second filter 15. A reduction gearbox 7 is disposed in front of the motor 6. An output shaft 20 is disposed in the reduction gearbox 7. One end of the output shaft 20 is connected to a crank shaft 8. One end of the crank shaft 8 is connected to a connecting rod 9. The connecting rod 9 has one end connected to the crank shaft 8 and the other end connected to a primary piston 4. A primary cylinder 3 is disposed at one end of the primary piston 4, and the other end of the primary piston 4 is connected to a secondary piston rod 19. A primary cylinder cover 2 is disposed at one end of the primary cylinder 3. A cylinder block 21 is fixed on the periphery of the primary cylinder 3. The primary cylinder cover 2 is connected to the noise attenuating first filter 1. The secondary piston rod 19 and the primary piston 4 are connected in a sealed manner. The other end of the secondary piston rod 19 is connected to a secondary piston 10. A secondary cylinder 11 is disposed at one end of the secondary piston 10. One end of the secondary cylinder 11 is connected to a cylinder cover 12. One end of the cylinder cover 12 is connected to a pressure relief valve 17, and the other side of the cylinder cover 12 is connected to the second filter 15 through a gas pipe 13.

A pressure gauge 14 is disposed above the second filter 15. A release valve 16 is disposed at a lower end of the second filter 15. An oil-water separation component 23 is disposed inside the second filter 15. One side of the second filter is provided with a high-pressure outlet 22.

A one-way valve block 31 is disposed between the primary cylinder cover 2 and the primary cylinder 3.

A gas storage chamber 18 is provided inside the primary piston 4. A primary one-way valve 41 is disposed at one end of the primary piston 4. A guide ring 42 is sleeved over the primary piston 4.

A vent 192 is provided inside the secondary piston rod 19. The vent 192 has one end connected to the gas storage chamber 18 and the other end connected to the secondary piston 10.

A secondary one-way valve 191 is disposed inside the secondary piston 10, and a one-way valve 101 is disposed on one side of the cylinder cover 12.

The cylinder block 21 is connected to the reduction gearbox 7.

A heat sink 5 is further disposed outside the secondary cylinder 11.

The primary piston 4 has a diameter and an area larger than those of the secondary piston rod 19.

Compression cavities are provided for the primary cylinder 3 and the secondary cylinder 11, the primary cylinder 3 and the secondary cylinder 11 are arranged such that the central axes of the primary cylinder 3 is radially offset from the central axes of the secondary cylinder 11, the central axes of the primary cylinder cavity is radially offset from the central axes of the secondary cylinder cavity, as shown in FIG. 1.

An operating principle of the present invention is as follows: The output of the motor 6 is decelerated by the reduction gearbox 7, so as to increase output torque. The crank shaft 8 is disc-shaped to reduce vibration during high-speed rotation. The crank shaft 8 drives the connecting rod 9 to carry out piston motion. Gas enters the primary cylinder 3 through the noise attenuating first filter 1 on the primary cylinder cover 2, and after being compressed by the primary piston 4, the gas enters the gas storage chamber 18 and becomes medium-pressure gas. A part of the medium-pressure gas further enters the secondary cylinder 11 from the gas storage chamber 18 through the vent 192 in the secondary piston rod and the secondary piston 10. Upon compression by the secondary piston 10, pressurized gas generated after being compressed twice passes through the one-way valve 101 to enter the second filter 15, and is then output via the outlet 22.

After using the foregoing technical solution, the present invention achieves the following beneficial effects: the primary cylinder and the secondary cylinder of the air pump are designed to be arranged such that central axis of secondary cylinder 11 is parallel to the central axis of primary cylinder 3, the central axes of the primary cylinder cavity is radially offset from the central axes of the secondary cylinder cavity, and the central axes of the primary piston 4 is radially offset from the central axes of the secondary piston 10, so that the pump applies balanced forces during operation, has a small size, achieves energy conservation and environmental protection, outputs gas under high pressure, and has good sealing performance.

The description above is merely used to illustrate rather than limiting the technical solution of the present invention. All other modifications or equivalent replacements made on the technical solution of the present invention by those of ordinary skill in the art without departing from the spirit and scope of the technical solution of the present invention should fall within the scope of the claims of the present invention.

What is claimed:

1. A two-stage high-pressure pump, comprising: a motor, a noise attenuating first filter and a second filter, wherein a reduction gearbox is disposed on a face of the motor; an output shaft is disposed in the reduction gearbox; a first end of the output shaft is connected to a crank shaft; a second end of the crank shaft is connected to a connecting rod; the connecting rod has one end connected to the crank shaft and another end connected to a primary piston at a location between the primary piston and a secondary piston; a primary cylinder is disposed at one end of the primary piston, and another end of the primary piston is connected to a secondary piston rod; a primary cylinder cover is disposed at one end of the primary cylinder; a cylinder block is fixed on a periphery of the primary cylinder, and the primary cylinder cover is connected to the noise attenuating first filter; the secondary piston rod and the primary piston are connected in a sealed manner; another end of the secondary piston rod is connected to the secondary piston; a secondary cylinder is disposed at one end of the secondary piston; one end of the secondary cylinder is connected to a cylinder cover; one end of the cylinder cover is connected to a pressure-relief valve, and another side of the cylinder cover is connected to the second filter through a gas pipe;

wherein the primary piston and the secondary piston are arranged for reciprocating movement as a single unit in the cylinder block along an axis and are oppositely disposed from one another, and each of the primary and the secondary pistons communicates with a respective compression cavity, each of the cavities consists of a compression area, and the compression cavities are oppositely disposed relative to one another, and the central axis of the primary piston is radially offset from the central axis of the secondary piston, and the end of the connecting rod connected to the primary piston is received in a recess formed in the primary piston.

2. The two-stage high-pressure pump according to claim 1, wherein a pressure gauge is disposed above the second filter, a release valve is disposed at a lower end of the second filter, an oil-water separation component is disposed inside the second filter, and one side of the second filter is provided with an outlet.

3. The two-stage high-pressure pump according to claim 1, wherein a one-way valve block is disposed between the primary cylinder cover and the primary cylinder.

4. The two-stage high-pressure pump according to claim 1, wherein a gas storage chamber is provided inside the primary piston, a primary one-way valve is disposed at the one end of the primary piston, and a guide ring is sleeved over the primary piston.

5. The two-stage high-pressure pump according to claim 1, wherein a vent is provided inside the secondary piston rod, and the vent has one end connected to a gas storage chamber and another end connected to the secondary piston.

6. The two-stage high-pressure pump according to claim 1, wherein a secondary one-way valve is disposed inside the secondary piston, and a one-way valve is disposed on one side of the cylinder cover.

7. The two-stage high-pressure pump according to claim 1, wherein the cylinder block is connected to the reduction gearbox.

8. The two-stage high-pressure pump according to claim 1, further comprising a heat sink disposed outside the secondary cylinder.

9. The two-stage high-pressure pump according to claim 1, wherein the primary piston has a diameter and an area larger than those of the secondary piston rod.

* * * * *